US005655260A

United States Patent [19]

Chang

[11] Patent Number: 5,655,260

[45] Date of Patent: Aug. 12, 1997

[54] ADJUSTABLE HANDLE DEVICE OF A SUITCASE

[76] Inventor: Wen-Chen Chang, 58, Ma Yuan West St., Taichung, Taiwan

[21] Appl. No.: 706,851

[22] Filed: Sep. 3, 1996

[51] Int. Cl.[6] ..... B25G 1/04

[52] U.S. Cl. ..... 16/115; 190/14; 190/18 A

[58] Field of Search ..... 16/115; 190/18 A, 190/18 R, 14, 15 R, 104; 280/47.315, 47.371, 655, 655.1

[56] References Cited

U.S. PATENT DOCUMENTS 4,577,877 3/1986 Kassai ..... 280/47.371

5,371,923 12/1994 Cang ..... 16/115

5,459,908 10/1995 Chen ..... 16/115

5,499,702 3/1996 Wang ..... 190/18 A

*Primary Examiner*—Chuck Y. Mah

[57] ABSTRACT

An adjustable handle device comprises a first handle, a second handle, a first and second inner pipes, and a first end second outer pipes. The first handle has a first and second hollow arms disposed at two opposite ends of the first handle. The first and second outer pipes are positioned in a suitcase. Two inner pipes are inserted in the corresponding outer pipes. The second handle is disposed under the first handle. Two driven rods are inserted in the corresponding inner pipes. The upper ends of each drive rod are inserted in the corresponding recess holes of the first handle.

1 Claim, 3 Drawing Sheets

ADJUSTABLE HANDLE DEVICE OF A SUITCASE

BACKGROUND OF THE INVENTION

The invention relates to an adjustable handle device. More particularly, the invention relates to a multistage adjustable handle device.

A conventional suitcase has a tractlie bracket at the back of the suitcase. The tractile bracket has an inner sleeve and an outer sleeve. Two positioning bolts screw the inner sleeve and the outer sleeve tightly. However, a user has to loosen the bolts in order to adjust the tractile bracket. Furthermore, the inner sleeve and the outer sleeve are easily deformed after a long period of usage.

SUMMARY OF THE INVENTION

An object of the present invention is to provide an adjustable handle device fox a suitcase so that the adjustable handle device can be protruded or retracted arbitrarily.

Accordingly, an adjustable handle device comprises a first handle, a second handle, a first and second inner pipes, and a first and second outer pipes. The first handle has a first and second hollow arms disposed at two opposite ends of the first handle. The first and second inner pipes are inserted in the corresponding first and second outer pipes respectively. Each of the first and second hollow arms has a first and second recess openings respectively, a first and second round holes formed on a lateral wall of each of the first and second recess openings respectively, and a first and second recess holes formed on an upper wall of each of the first and second recess openings respectively. The second handle has a first and second hollow cylinders disposed at two opposite ends of the second handle. Each of the first and second hollow cylinders has a first and second through holes and a first and second circular holes respectively. A first and second hollow disks are embedded in the corresponding first and second inner pipes respectively. Each of the first and second inner pipes has an oblong hole on an upper end of each of the first and second inner pipes, and a first, second and third positioning holes on a lower end of the first and second inner pipes. Each of the first and second outer pipes has a plurality of first and second insert holes. Each of a first and second spring seats is disposed in a lower end of each of the corresponding first and second inner pipes respectively. Each of the first and second spring seats receives each of a corresponding first and second compression springs respectively. Each of a first and second plates is inserted in each of the corresponding first and second inner pipes respectively to compress each of the corresponding first and second compression springs. The first spring seat has two lateral slots, a first protrusion disposed on an upper portion of the first spring seat, a first solid disk disposed at a bottom of the first spring seat, and a first protruded post protruded upward from the first solid disk. The second spring seat has two lateral slots, a second protrusion disposed on an upper portion of the second spring seat, a second solid disk disposed at a bottom of the second spring seat, and a second protruded post protruded upward from the second solid disk. The first plate has a first upper and lower lateral flat surfaces, a first flat recess, a first rib, a first inner flange and a first bevel block. A first curved hole is formed abutting the first lower lateral flat surface. A first torsion spring has a first curved tip. A first pin is inserted in the first curved hole. The first pin has a first head and a first shank. A first center hole is formed on the first head. The first torsion spring is inserted in the first flat recess. The first curved tip is inserted in the first center hole. The first shank is inserted in the first curved hole and one of the first insert holes. The second plate has a second upper and lower lateral flat surfaces, a second flat recess, a second rib, a second inner flange and a second bevel block. A second curved hole is formed abutting the second lower lateral flat surface. A second torsion spring has a second curved tip. A second pin is inserted in the second curved hole. The second pin has a second head and a second shank. A second center hole is formed on the second head. The second torsion spring is inserted in the second flat recess. The second curved tip is inserted in the second center hole. The second shank is inserted in the second curved hole and one of the second insert holes. Each of an upper portion of the first and second outer pipes receives each of the corresponding first and second hollow cylinders respectively. A first screw fastens the first outer pipe and the first hollow cylinder together. A second screw fastens the second outer pipe and the second hollow cylinder together. Each of an upper portion of the first and second inner pipes is inserted in each of the corresponding first and second hollow arms respectively. A first bolt fastens the first inner pipe and the first hollow arm together. A second bolt fastens the second inner pipe and the second hollow arm together. A first coil spring is inserted in the first inner pipe and blocked by the first hollow disk. A second coil spring is inserted in the second inner pipe and blocked by the second hollow disk. A first and second driven rods are inserted in the corresponding first and second inner pipes respectively. An upper end of the first driven rod is inserted in the first recess hole. An upper end of the second driven rod is inserted in the second recess hole. A lower end of the first driven rod is blocked by the first plate. A lower end of the second driven rod is blocked by the second plate.

DETAILED DESCRIPTION OF THE INVENTION

Figure 1:
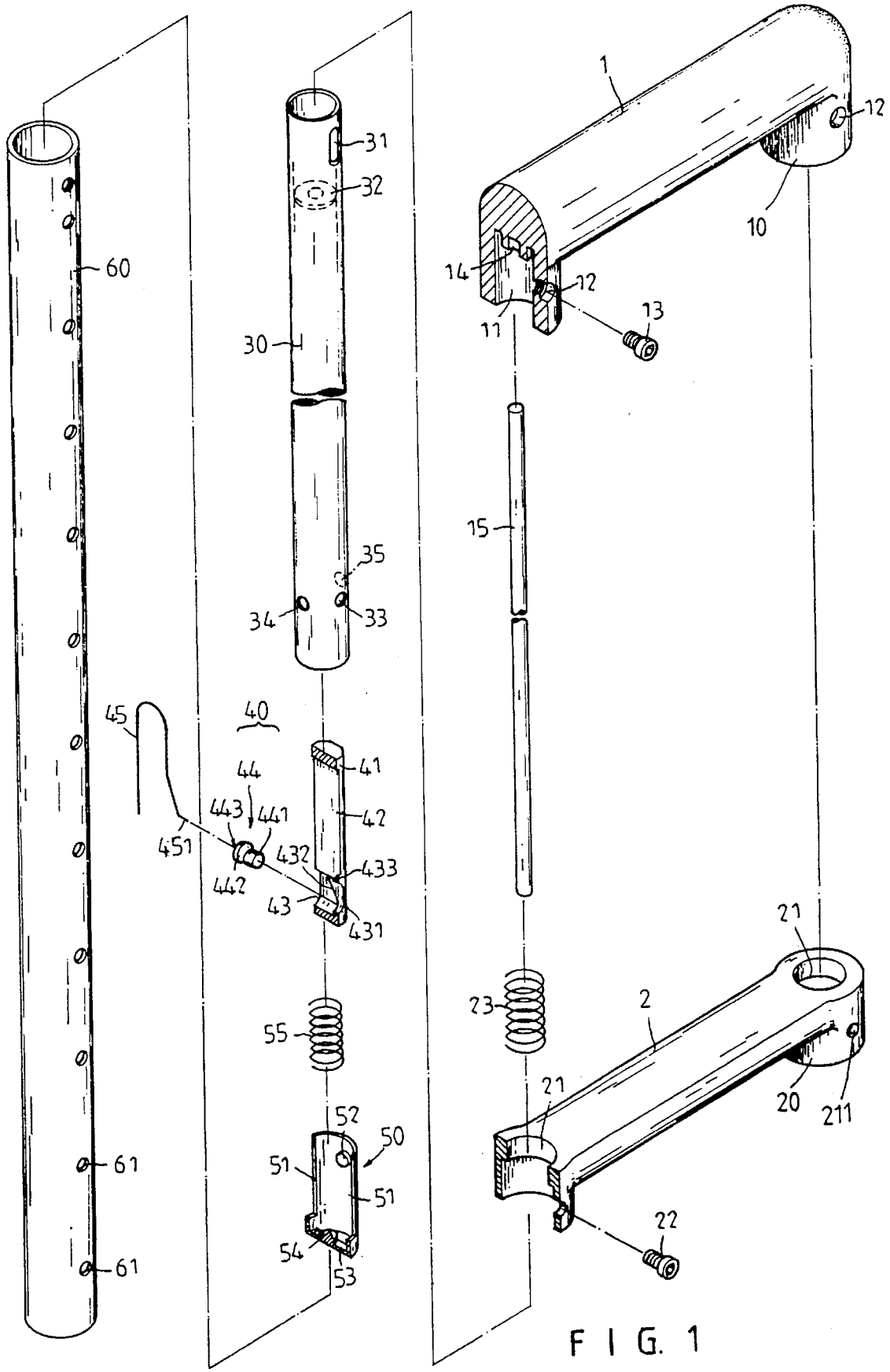
FIG. 1 is a partially perspective exploded view of a preferred embodiment in accordance with the invention.
Figure 2:
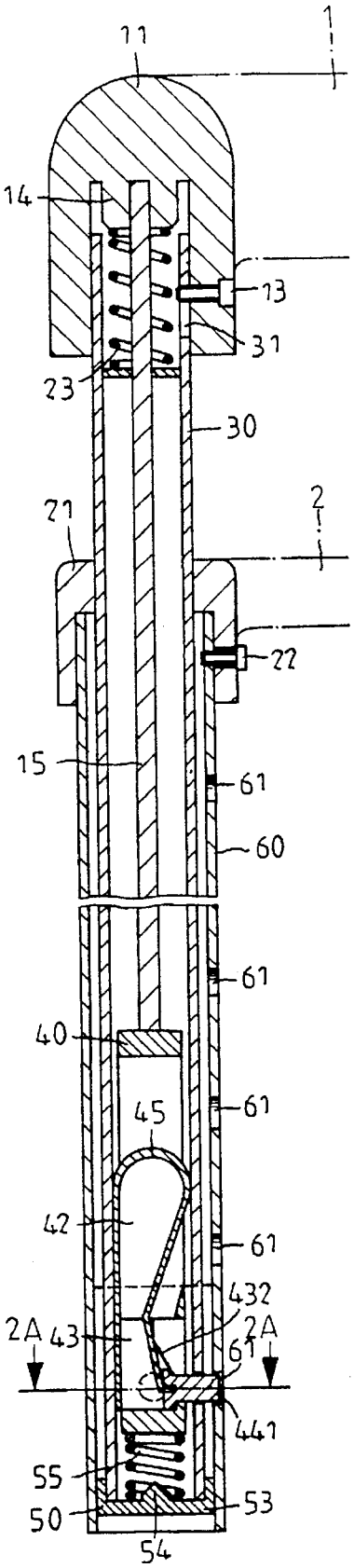
FIG. 2 is a partially sectional assembly view of an adjustable handle device while the adjustable handle device is retracted.
Figure 2A:
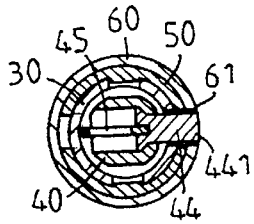
FIG. 2A is a sectional view taken along line 2A—2A in FIG. 2.
Figure 3:
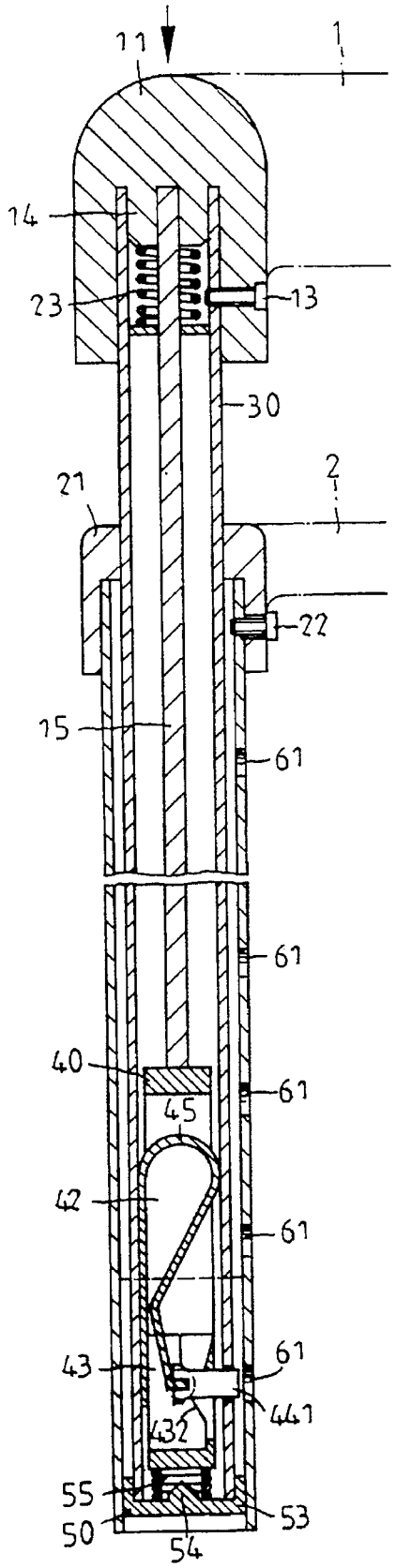
FIG. 3 is a partially sectional assembly view of an adjustable handle device while the adjustable handle device is protruded.
Figure 3A:
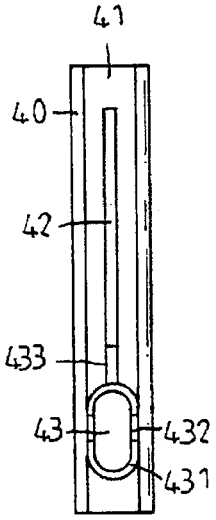
FIG. 3A is an elevational view of a plate.

Referring to FIG. 1, an adjustable handle device comprises a first handle 1, a second handle 2, a first and second inner pipes 30, and a first and second outer pipes 60. The first handle 1 has a first and second hollow arms 10 disposed at two opposite ends of the first handle 1. The first and second outer pipes 60 are positioned in a suitcase (not shown in the figures). The first and second inner pipes 30 are inserted in the corresponding first and second outer pipes 60 respectively. Each of the first and second hollow arms 10 has a first and second recess openings 11 respectively, a first and second round holes 12 formed on a lateral wall of each of the first and second recess openings 11 respectively, and a first and second recess holes 14 formed on an upper wall of each of the first and second recess openings 11 respectively. The second handle 2 has a first and second hollow cylinders 20 disposed at two opposite ends of the second handle 2. Each of the first and second hollow cylinders 20 has a first and second through holes 21 and a first and second circular holes 211 respectively. A first and second hollow disks 32 are embedded in the corresponding first and second inner pipes 30 respectively. Each of the first and second inner pipes 30 has an oblong hole 31 on an upper end of each of the first and second inner pipes 30, and a first, second and third positioning holes 33, 34 and 35 on a lower end of the first and second inner pipes 30. Each of the first and second outer pipes 60 has a plurality of first and second insert holes 61. Each of a first and second spring seats 50 is disposed in a lower end of each of the corresponding first and second inner pipes 30 respectively. Each of the first and second spring seats 50 receives each of a corresponding first and second compression springs 55 respectively. Each of a first and second plates 40 is inserted in each of the corresponding first and second inner pipes 30 respectively to compress each of the corresponding first and second compression springs 55. The first spring seat 50 has two lateral slots 51, a first protrusion 52 disposed on an upper portion of the first spring seat 50, a first solid disk 53 disposed at a bottom of the first spring seat 50, and a first protruded post 54 protruded upward from the first solid disk 53. The second spring seat 50 has two lateral slots 51, a second protrusion 52 disposed on an upper portion of the second spring seat 50, a second solid disk 53 disposed at a bottom of the second spring seat 50, and a second protruded post 54 protruded upward from the second solid disk 53. The first plate 40 has a first upper and lower lateral flat surfaces 41, a first flat recess 42, a first rib 433, a first inner flange 431 and a first bevel block 432. A first curved hole 43 is formed abutting the first lower lateral flat surface 41. A first torsion spring 45 has a first curved tip 451. A first pin 44 is inserted in the first curved hole 43. The first pin 44 has a first head 442 and a first shank 441. A first center hole 443 is formed on the first head 442. The first torsion spring 45 is inserted in the first flat recess 42. The first curved tip 451 is inserted in the first center hole 443. The first shank 441 is inserted in the first curved hole 43 and one of the first insert holes 61. The second plate 40 has a second upper and lower lateral flat surfaces 41, a second flat recess 42, a second rib 433, a second inner flange 431 and a second bevel block 432. A second curved hole 43 is formed abutting the second lower lateral flat surface 41. A second torsion spring 45 has a second curved tip 451. A second pin 44 is inserted in the second curved hole 43. The second pin 44 has a second head 442 and a second shank 441. A second center hole 443 is formed on the second head 442. The second torsion spring 45 is inserted in the second flat recess 42. The second curved tip 451 is inserted in the second center hole 443. The second shank 441 is inserted in the second curved hole 43 and one of the second insert holes 61. Each of an upper portion of the first and second outer pipes 60 receives each of the corresponding first and second hollow cylinders 20 respectively. A first screw 27 fastens the first outer pipe 60 and the first hollow cylinder 20 together. A second screw 27 fastens the second outer pipe 60 and the second hollow cylinder 20 together. Each of an upper portion of the first and second inner pipes 30 is inserted in each of the corresponding first and second hollow arms 10 respectively. A first bolt 13 fastens the first inner pipe 30 and the first hollow arm 10 together. A second bolt 13 fastens the second inner pipe 30 and the second hollow arm 10 together. A first coil spring 23 is inserted in the first inner pipe 30 and blocked by the first hollow disk 32. A second coil spring 23 is inserted in the second inner pipe 30 and blocked by the second hollow disk 32. A first and second driven rods 15 are inserted in the corresponding first and second inner pipes 30 respectively. An upper end of the first driven rod 15 is inserted in the first recess hole 14. An upper end of the second driven rod 15 is inserted in the second recess hole 14. A lower end of the first driven rod 15 is blocked by the first plate 40. A lower end of the second driven rod 15 is blocked by the second plate 40.

Referring to FIGS. 1, 2, 2A, 3 and 3A, the first handle 1 can be retracted or protruded. The first handle 1 is pressed downward to drive the first and second driven rods 15 to move downward. The first and second plates 40 are driven by the corresponding first and second driven rods 15 to move downward. The first and second pins 44 are released from the corresponding insert holes 61. The first handle 1 is released upward to drive the first and second driven rods 15 to move upward. The first and second pins 44 engage with the corresponding insert holes 61.

The invention is not limited to the above embodiment but various modification thereof may be made. It will be understood by those skilled in the art that various changes in form and detail may be made without departing from the spirit and scope of the invention.

I claim:

1. An adjustable handle device comprising:

a first handle, a second handle, a first and second inner pipes, and a first and second outer pipes, the first handle having a first and second hollow arms disposed at two opposite ends of the first handle, the first and second inner pipes inserted in the corresponding first and second outer pipes respectively, each of the first and second hollow arms having a first and second recess openings respectively, a first and second round holes formed on a lateral wall of each of the first and second recess openings respectively, and a first and second recess holes formed on an upper wall of each of the first and second recess openings respectively, the second handle having a first and second hollow cylinders disposed at two opposite ends of the second handle, each of the first and second hollow cylinders having a first and second through holes and having a first and second circular holes formed on a lateral wall thereof, respectively, a first and second hollow disks embedded in the corresponding first and second inner pipes respectively, each of the first and second inner pipes having an oblong hole on an upper end of each of the first and second inner pipes, and a first, second and third positioning holes on a lower end of the first and second inner pipes, each of the first and second outer pipes having a plurality of first and second insert holes, each of a first and second spring seats disposed in a lower end of each of the corresponding first and second inner pipes respectively, each of the first and second spring seats receiving each of a corresponding first and second compression springs respectively, each of a first and second plates inserted in each of the corresponding first and second inner pipes respectively to compress each of the corresponding first and second compression springs, the first spring seat having two lateral slots, a first protrusion disposed on an upper portion of the first spring seat, a first solid disk disposed at a bottom of the first spring seat, and a first protruded post protruded upward from the first solid disk, the second spring seat having two lateral slots, a second protrusion disposed on an upper portion of the second spring seat, a second solid disk disposed at a bottom of the second spring seat, and a second protruded post protruded upward from the second solid disk, the first plate having a first upper and lower lateral flat surfaces, a first flat recess, a first rib, a first inner flange and a first bevel block, a first curved hole formed abutting the first lower lateral flat surface, a first torsion spring having a first curved tip, a first pin inserted in the first curved hole, the first pin having a first head and a first shank, a first center hole is formed on the first head, the first torsion spring inserted in the first flat recess, the first curved tip inserted in the first center hole, the first shank inserted in the first curved hole and one of the first insert holes, the second plate having a second upper and lower lateral flat surfaces, a second flat recess, a second rib, a second inner flange and a second bevel block, a second curved hole formed abutting the second lower lateral flat surface, a second torsion spring having a second curved tip, a second pin inserted in the second curved hole, the second pin having a second head and a second shank, a second center hole formed on the second head, the second torsion spring inserted in the second flat recess, the second curved tip inserted in the second center hole, the second shank inserted in the second curved hole and one of the second insert holes, each of an upper portion of the first and second outer pipes receiving each of the corresponding first and second hollow cylinders respectively, a first screw fastening the first outer pipe and the first hollow cylinder together through said second circular hole, a second screw fastening the second outer pipe and the second hollow cylinder together through said second circular hole, each of an upper portion of the first and second inner pipes inserted in each of the corresponding first and second hollow arms respectively through said first round hole, a first bolt fastening the first inner pipe and the first hollow arm together through said first round hole, a second bolt fastening the second inner pipe and the second hollow arm together through said second round hole, a first coil spring inserted in the first inner pipe and abutting the first hollow disk, a second coil spring inserted in the second inner pipe and abutting the second hollow disk, a first and second driven rods inserted in the corresponding first and second inner pipes respectively, an upper end of the first driven rod inserted in the first recess hole, an upper end of the second driven rod inserted in the second recess hole, a lower end of the first driven rod abutting the first plate, a lower end of the second driven rod abutting the second plate, wherein when the first handle is pressed downward to drive the first and second driven rods to move downward, the first and second plates are driven by the corresponding first and second driven rods to move downward, thereby causing the first and second pins to be released from the corresponding insert holes; when the first handle is released upward to drive the first and second driven rods to move upward, the first and second pins engage with the corresponding insert holes.

* * * * *